US007033052B2

(12) United States Patent
Kazaoka et al.

(10) Patent No.: US 7,033,052 B2
(45) Date of Patent: Apr. 25, 2006

(54) VEHICULAR LAMP

(75) Inventors: Naoki Kazaoka, Shizuoka (JP); Kazunori Natsume, Shizuoka (JP); Yasuyuki Amano, Shizuoka (JP); Toshiyuki Shirai, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 188 days.

(21) Appl. No.: 10/798,490

(22) Filed: Mar. 11, 2004

(65) Prior Publication Data

US 2004/0208016 A1 Oct. 21, 2004

(30) Foreign Application Priority Data

Mar. 11, 2003 (JP) ..... P.2003-064337

(51) Int. Cl.
*F21V 8/00* (2006.01)

(52) U.S. Cl. ..... 362/511; 385/146

(58) Field of Classification Search ..... 362/511, 362/507, 509, 520; 385/146
See application file for complete search history.

(56) References Cited

U.S. PATENT DOCUMENTS

| | | | | |
|---|---|---|---|---|
| 4,389,698 A * | 6/1983 | Cibie | ..... | 362/511 |
| 5,506,929 A * | 4/1996 | Tai et al. | ..... | 385/146 |
| 6,367,957 B1 * | 4/2002 | Hering et al. | ..... | 362/511 |

FOREIGN PATENT DOCUMENTS

| | | |
|---|---|---|
| JP | 2001-283616 | 10/2001 |
| JP | 2002-109907 | 4/2002 |
| JP | 2002-184212 | 6/2002 |

* cited by examiner

*Primary Examiner*—Renee Luebke
*Assistant Examiner*—Leah Lovell
(74) *Attorney, Agent, or Firm*—Koda & Androlia

(57) ABSTRACT

A vehicular lamp including, within a lamp chamber s defined by a lamp body 10 and an outer cover 20, an led 28 which is the light source, and a light guide 24 which guides light emitted from the led 28 by internal reflection so as to emit light at a plurality of locations. the light guide 24 is constructed of a coupling unit u1 that extends along the outer cover 20 and is made of a plurality of light guiding members 25, the surface of each light guiding member 25 formed in an elliptical surface 25*a* that has a pair of focal points f, are coupled in series while sharing the focal points with each other at coupling portions 26, and the focal points f at both end portions of the light guide 24 (coupling unit u1) are near the light-emitting portion 29 of the led 28.

9 Claims, 11 Drawing Sheets

VEHICULAR LAMP

BACKGROUND OF THE INVENTION

1. Field of the Invention

The present invention relates to a vehicular lamp and more particularly to a vehicular (tail/brake) lamp that employs light-emitting devices such as light-emitting diodes (LED) as a light source thereof.

2. Prior Art

A vehicular lamp employing a number of LEDs as light sources is popular since it provides a substantial amount of light emission and also provides a luxurious appearance. However, LEDs have a high directivity compared to general bulbs; and thus, so as to emit light from the entire front cover (including the lens) of the lamp, a correspondingly large number of LEDs are required, and this results in a high cost product.

In view of the above, various structures are disclosed in, for instance, Japanese Patent Application Laid-Open (Kokai) Nos. 2002-184212, 2001-283616 and 2002-109907 in order to make lamps appear like a multi-light type lamp (that includes a plurality of LEDs) by dispersing light emitted from the LEDs.

The structures in Japanese Patent Application Laid-Open (Kokai) Nos. 2002-184212 and 2001-283616 employ, as shown in FIGS. 11 and 12, respectively, a construction in which an LED 4 is provided to face forward at a substantially central position of a first reflector 2, and a second reflector 6 is provided to cover the LED 4, so that light emitted from the LED 4 is reflected by the reflectors 6 and 2 and distributed in the forward direction as shown by arrows. Reference numeral 3 denotes lenses that cover the front face of a lamp chamber.

In Japanese Patent Application Laid-Open (Kokai) No. 2002-109907, as shown in FIG. 13, the LED 4 is disposed to face rearward in front of a substantially central portion of the first reflector 2, such that light emitted from the LED 4 is reflected by the reflector 2 and distributed in the forward direction as shown by arrows. Reference numeral 5 denotes a mounting member for mounting the LED 4 to the lens 3. Reference characters f1 and f2 indicate focal points of the reflecting surfaces of the reflectors.

However, in the above-described prior arts, the second reflector 6 and the LED mounting member 5 are provided on the backside of (or behind) the lens 3. Accordingly, a non-translucent portion 3*a* is required in the lens 3, causing a poor appearance to the lamp when the lamp is not lit.

In addition, to disperse light emitted from the LED having directivity to a plurality of locations, it is necessary that the LED be arranged sufficiently apart from the reflector; and this causes problems that the depth of the lamp tends to be large and also a degree of freedom of design choice is restricted.

There also exists a related art in which a light guiding member provided at an inner side of a lens is made to emit light by an LED, allowing an improved appearance to the lamp when the lamp is not lit and making the lamp thinner. However, this art is designed to emit light from the entire light guiding member having a flat shape (surface emission) and is extremely difficult to make the lamp appear like a multi-light type lamp.

Therefore, the inventors of the present application conceived an idea to let an elliptical surface guide light. More specifically, the inventors assumed that by constructing a light guiding member with an elliptical body and arranging the light-emitting portion of an LED at a first focal point of the elliptical surface of the light guiding member, most of the light emitted from the LED is internally reflected by the elliptical surface and is condensed at a second focal point, thereby emitting light from the second focal point; and, moreover, by way of arranging a plurality of light guiding members each having an elliptical body shape and coupling them in series in such a manner that they share the focal points, light emission is guided up to the focal point of the rearmost light guiding member from the light-emitting portion of the LED, and the light is emitted therefrom. Based on these concepts, a prototype was made, and it was found that such has a great effectiveness of which was confirmed, and the present invention has been created.

SUMMARY OF THE INVENTION

The present invention is in consideration of the above-described problems of the related arts and is based on the findings of the inventors described above.

It is an object of the present invention to provide a vehicular lamp that appears like a multi-light type lamp and has a good appearance by constructing the lamp such that light emitted from an LED is lit at a plurality of locations by the use of a light guide.

The above object is accomplished by a unique structure of the present invention for a vehicular lamp that includes a lamp chamber, which is defined by a lamp body and a front cover, and a light guide, which is installed in the lamp chamber and emits light at a plurality of locations thereof by guiding, by internal reflection, light emitted from an LED that is a light source of the vehicular lamp; and in the present invention, the light guide is constructed of a coupling unit in which a plurality of light guiding members, each one of the light guiding members being formed with an elliptical surface that has a pair of focal points, are coupled in series at coupling portions so that the light guiding members share one of the focal points with each other at each one of the coupling portions; and the light-emitting portion of the LED is provided near at least one of the focal points which are at both ends of the coupling unit.

The "front cover" includes a so-called "front lens" provided with steps, in addition to a so-called plain "front cover" that is not provided with steps.

In the above structure according to the first aspect of the present invention, the light-emitting portion of the LED is provided near the focal point of the elliptical surface of the light guiding member on the coupling unit end portion. Accordingly, light emitted from the LED and is incident to the light guide (comprised of the light guiding members) is repeatedly internally reflected by (the elliptical surface of) each light guiding member and reaches the other end of the light guide (coupling unit). Meanwhile, light emitted from the LED is condensed at the shared focal points located at the coupling portions between the light guiding members, and light is emitted from the coupling portions.

Furthermore, a reflecting surface can be provided behind the light guide with a space in between; and in addition, an inner lens that has a predetermined functional color can be provided between the light guide and the reflecting surface so as to be separated from at least the reflecting surface. With this structure, when the LED is lit, a number of light-emitting portions are reflected on the reflecting surface, and thus, the lamp appears as if myriads of light-emitting portions exist in the lamp chamber. When the LED is not lit, the coupling unit that is comprised of the coupled and integrated light guiding members in series is reflected on the reflecting surface, and the lamp appears as if an innovative pattern, in which a shape defined by the profile of the light guiding member (for instance, a long narrow oval) continues lengthwise and widthwise, exists on the front cover or the reflecting surface in the lamp chamber. In particular, when the inner lens is provided between the light guide and the reflecting surface, an image (light-emitting portion or pattern) that is visible through repeated reflections of the light-emitting portions on the reflecting surface appears small by the lengthened amount of a light path, giving an appearance that the lamp chamber has a depth by corresponding amount.

In the second aspect of the present invention, the LEDs are provided at both end portions of the coupling unit that is formed by a plurality of light guiding members connected in series.

In this structure of the second aspect of the present invention, light emitted from the LEDs is guided to the coupling portion of each light guiding member constituting the coupling unit through the light guiding members which are at both end portions of the coupling unit. Accordingly, compared to the case in which light emitted from a single LED is guided to the light guiding member, the amount of light emission at the coupling portion of the light guiding member is doubled in the second aspect of the present invention. Though the amount of light emission at the coupling portions of the light guiding members reduces near the center of the coupling unit, since the light emission from the LEDs is incident from both end portions of the coupling unit, the amount of light emission can be uniform at every coupling portion of the coupling unit.

In the third aspect of the present invention, the light guiding member can be an elliptical body that has a single elliptical surface on its entire outer surface, or it can, alternatively, be a semi-elliptical body that is obtained by dividing the elliptical body longitudinally along its major axis; and either one of these two types of the light guiding members is arranged such that the elliptical surface faces the front cover of the lamp chamber. In addition, the light guiding member that faces the light-emitting portion of the LED is arranged such that the major axis of the elliptical body substantially coincides with the axis of the light-emitting portion of the LED.

In this structure of the third aspect of the present invention, since most of the light emitted from the LED is incident to the light guiding member, the brightness of light emission of each coupling portion between the light guiding members that form the coupling unit increases.

In the fourth aspect of the present invention, the coupling unit is constructed of an integrally molded resin unit.

In the structure in which separate light guiding members are coupled and integrated with each other, part of light guided in the coupling unit is lost at the coupling portion. However, in the fourth aspect of the present invention in which the coupling unit is an integrally molded resin unit, loss of light does not occur at the coupling portions, and light is guided to another end portion of the coupling unit without involving loss of light emitted from the LED.

Moreover, the structure in which separate light guiding members are coupled and integrated with each other requires a work of coupling the light guiding members. However, when the coupling unit is an integrally molded resin unit, such work is not required.

In the fifth aspect of the present invention, one end of the light guiding member has a recessed portion which is aligned with a protruded portion which is on the other end of the light guiding member, and the protruded portion of one light guiding member is engaged with the recessed portion of another light guiding member, thus allowing the plurality of light guiding members are coupled with or connected to each other in series.

It the above structure, so as to make light emitted from the LEDs be incident from both end portions of the coupling unit, it is necessary that the light guiding member at one end portion of the coupling unit has the recessed portion that faces the light-emitting portion of the LED, and the light guiding member at another end portion of the coupling unit has recessed portions at both ends thereof so that one recessed portion is connected to the protruded portion of the next light guiding member and another recessed portion faces (receives) the light-emitting portion of the LED.

In this structure of the fifth aspect of the present invention, the plurality of light guiding members that form the light guide (coupling unit) can be identical to each other. Thus, a low manufacturing cost can be achieved. Furthermore, by engaging the protruded portion of one light guiding member with the recessed portion of another light guiding member, a plurality of light guiding members can be coupled easily. Moreover, since the protruded portion and the recessed portion can be relatively rotatable (relatively oscillated) to some extent, the light guide (coupling unit) can bend at the coupling portions, so that the light guide (coupling unit) is provided so as to follow the curvature of the front cover.

The above object is accomplished by another unique structure of the present invention for a vehicular lamp that includes a lamp chamber, which is defined by a lamp body and a front cover, and a light guide, which is installed in the lamp chamber and emits light at a plurality of locations thereof by guiding, by internal reflection, light emitted from an LED that is a light source of the vehicular lamp; and in the present invention, the light guide is constructed of a coupling unit in which a plurality of light guiding members, each one of the light guiding members being formed with an elliptical surface that has a pair of focal points, are coupled and integrated in a radial form at a coupling portion so that the light guiding members share one of the focal points with each other at the coupling portion; and the light-emitting portion of the LED is provided near the shared focal points located behind the LED.

In this structure according to the sixth aspect of the present invention, the light-emitting portion of the LED is located near the shared focal point of each elliptical surface at the central portion of the light guide (or at the coupling portion at the center of the coupling unit). Accordingly, light, which is emitted from the LED and is incident to each light guiding member, is internally reflected by (the elliptical surface of) each light guiding member, and is condensed at the focal point located at the other end of the light guiding member and is then emitted from the other end of each light guiding member.

In the above structure, the tip portion of each light guiding member can be provided with a guided light-emitting portion that emits, in the rearward direction, light guided through the light guiding member and condensed at the focal point; and a reflecting surface which reflects the light guided through the guided light-emitting portion in the forward direction can be provided behind the guided light-emitting portion. With this structure, each light emission area at a plurality of locations on the light guide can be made larger.

Furthermore, in the seventh aspect of the present invention, in the above structure, the light guiding member can be an elliptical body that has a single elliptical surface on its entire outer surface, or it can, alternatively, be a semi-elliptical body that is obtained by dividing the elliptical body longitudinally along its major axis; and either one of these two types of the light guiding members is arranged such that the elliptical surface faces the front cover of the lamp chamber. In addition, the LED provided behind the central portion of the coupling unit is arranged so that the optical axis of the light-emitting portion of the LED is orthogonal to the coupling unit.

In this structure, the back surface of the central portion of the light guide (coupling portion at the center of the coupling unit) can be provided with a recess so that the light-emitting portion of the LED is engaged with this recess. When the light-emitting portion of the LED is engaged with this recess, the optical axis of the light-emitting portion becomes orthogonal to the major axis of each light guiding member that is of an elliptical shape, and also, the center of light emission comes to be on the major axis of the elliptical light guiding member. Therefore, most of the light emitted from the LED is uniformly distributed and incident to each light guiding member, and the tip portions of the light guiding members have a uniform light emission amount.

DETAILED DESCRIPTION OF THE INVENTION

Hereafter, embodiments of the present invention will be described in detail based on the examples.

Figure 1:
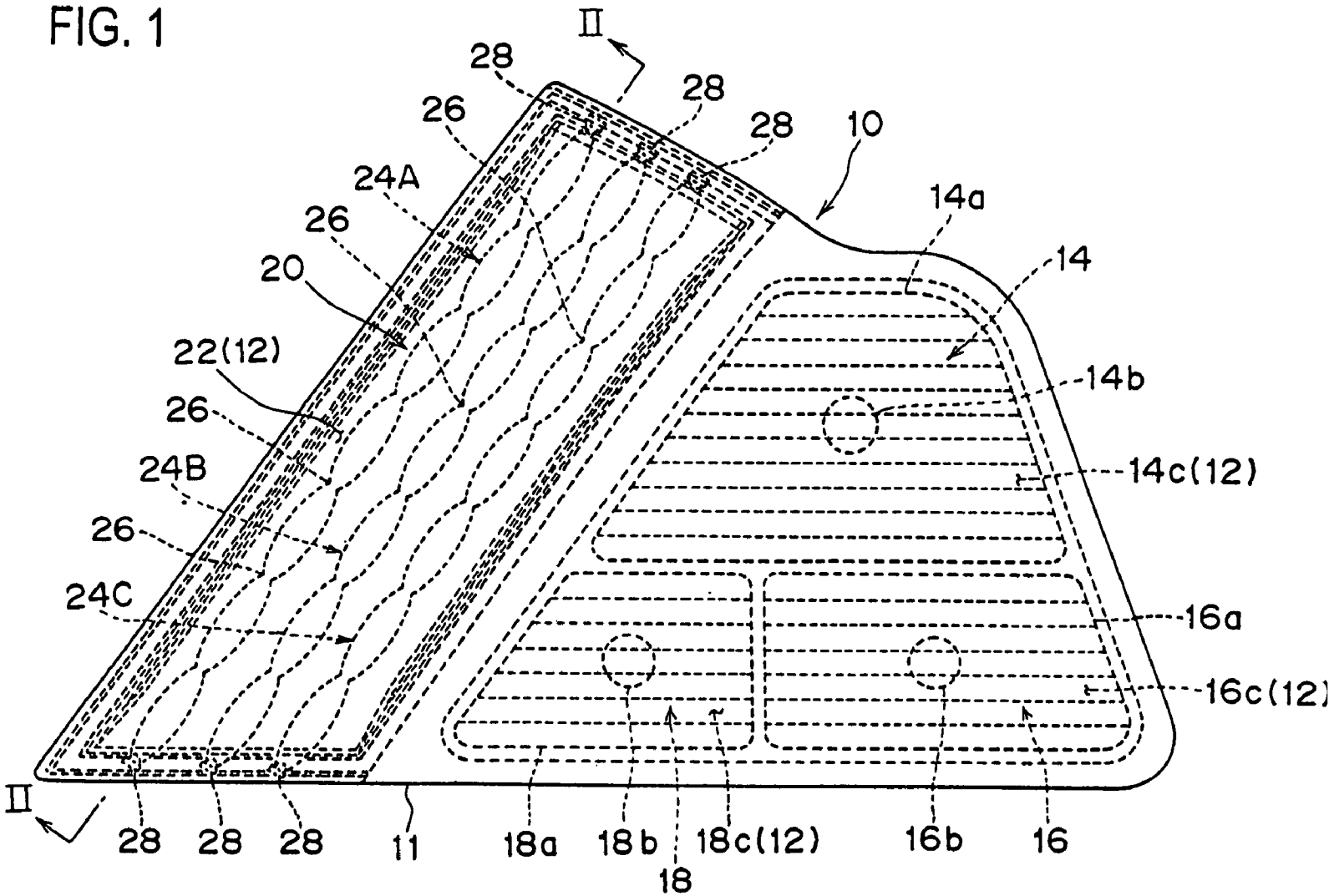
FIG. 1 is a front elevational view of an automotive rear combination lamp integrated with a tail lamp according to a first embodiment of the present invention.
Figure 2:
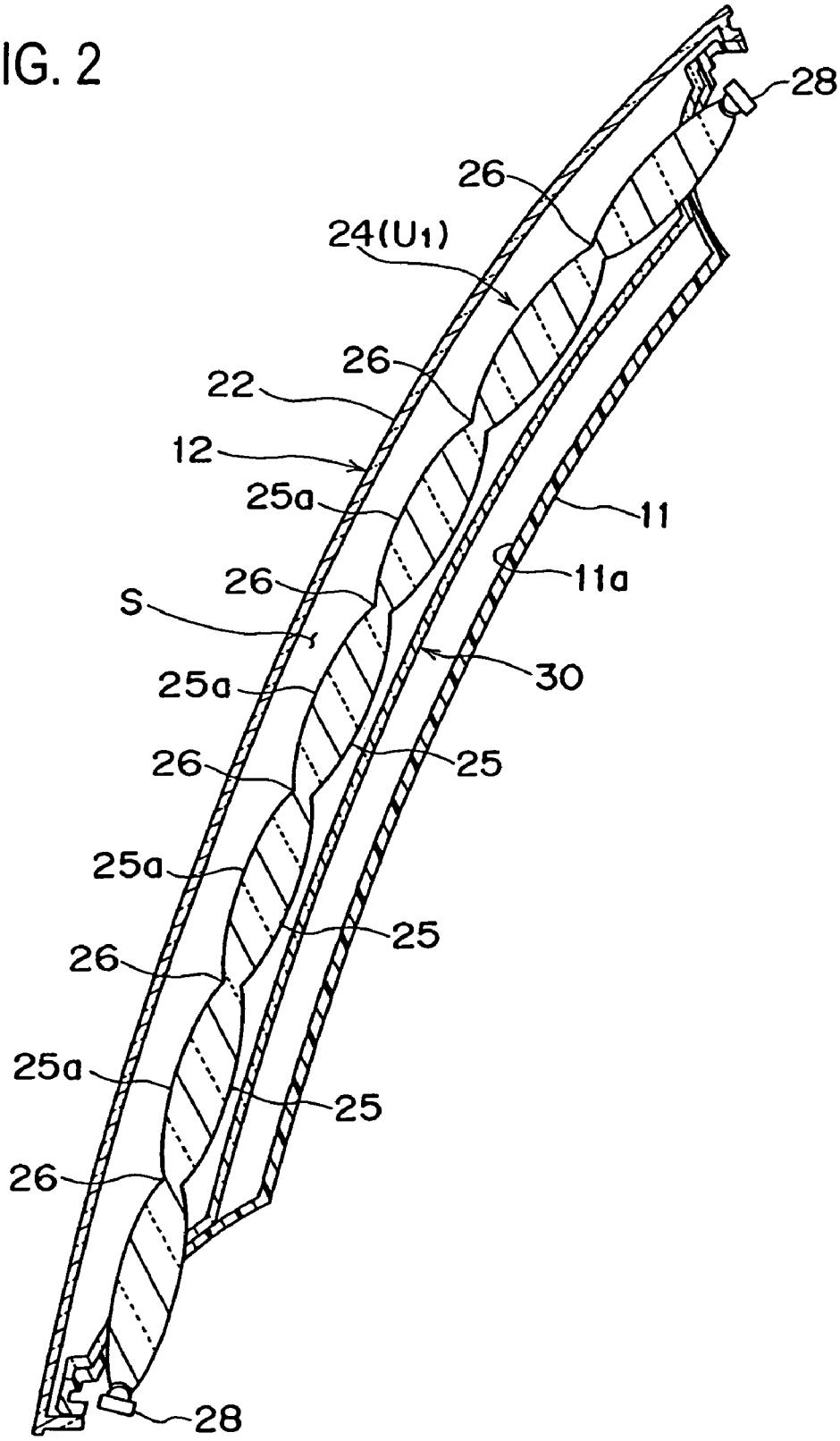
FIG. 2 is an enlarged longitudinal sectional view thereof taken along the line II—II in FIG. 1.
Figure 3:
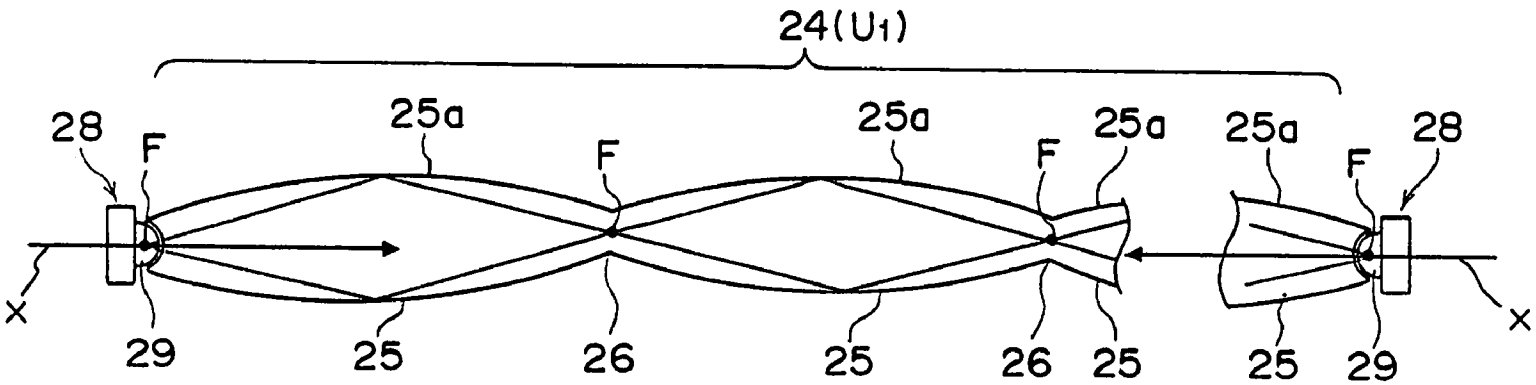
FIG. 3 shows the light guiding member which is the main portion of the combination lamp.

FIGS. 1 to 3 show a first embodiment in which the present invention is applied to an automotive tail lamp.

In FIG. 1, the reference numeral 10 denotes a rear combination lamp installed in the right side corner of the rear part of an automobile; and this lamp includes a tail lamp 20, a stop lamp 14, a turn signal lamp 16 and a backup lamp 18 that are integrated.

More specifically, the lamp body 11 of the rear combination lamp 10 has lamp chambers which correspond to lamps 14, 16 and 18, respectively. In the lamp chambers corresponding to the lamps 14, 16 and 18, parabolic reflectors 14*a*, 16*a* and 18*a* and bulbs 14*b*, 16*b* and 18*b* which are the light sources are accommodated. A front cover 12 (see FIG. 2) assembled to a front face open portion of the lamp body 11 is integrated with outer covers 22, 14*c*, 16*c* and 18*c* which, respectively, correspond to the lamps 20, 14, 16 and 18. The outer covers (outer lenses) 14*c*, 16*c* and 18*c* take on a functional color of respective lamps (the cover 14*c* is red, the cover 16*c* is amber and the cover 18*c* is white). The outer covers 14*c*, 16*c* and 18*c* emit light in their respective functional colors when the bulbs 14*b*, 16*b* and 18*b* are lit.

A lamp chamber S which corresponds to the tail lamp 20 and which is defined by the lamp body 11 and a transparent outer cover 22 accommodates therein three bar-shaped light guides 24 (24A, 24B and 24C). The bar-shaped light guides 24 (24A, 24B and 24C) are arranged in parallel in diagonal direction in a front elevational view as shown in FIG. 3, and each light guide is formed with narrowed portions 26 that serve as coupling portions at equal intervals in the longitudinal direction of the light guide. Both end portions of the bar-shaped light guides 24A, 24B and 24C that penetrate the lamp body 11 to extend to the outside of the lamp chamber S are provided with LEDs 28 so that the LEDs 28 are in coaxial with the respective light guides such that the narrowed portions 26 of the bar-shaped light guides 24A, 24B and 24C emit light when the LEDs 28 are lit.

More specifically, the light guide 24 is, as shown in FIG. 3, constructed of a coupling unit U1 in which elliptical light guiding members 25, each one of the light guiding members 25 having an elliptical surface 25*a* that has a pair of focal points F located at both ends of the light guiding member, are integrally coupled in series lengthwise in a manner that they share the focal points at the narrowed portion (coupling portion) 26. The coupling unit U1, in substantially a linear shape body, is constructed of an integrally molded unit of transparent acrylic resin and can be formed simply by injection molding.

The coupling unit U1 constituting the light guide 24 extends along the outer cover 22; and, as shown in FIG. 3, a light-emitting portion 29 of each one of the two LEDs 28 is provided at a position of the focal point of the light guiding members 25 at both end portions of the coupling unit U1. The LED 28 is provided so that the optical axis x of the light-emitting portion 29 coincides with the major axis of the light guiding member 25 which is an elliptical body. Furthermore, light incident to the light guiding members 25 from the light-emitting portion 29 of the LED 28 is repeatedly internally reflected by (the elliptical surface 25*a* of) each light guiding member 25 and reaches the other end portion of the light guide 24 (coupling unit U1), light is condensed at shared focal points F located at the narrowed portions (coupling portions) 26 between the adjacent light guiding members 25, and light is emitted from each narrowed portion 26.

Accordingly, by lighting a total of six LEDs 28, the narrowed portions (coupling portions 26) of the connected light guiding members 25 constituting the coupling unit U1 emit light. In other words, in the shown embodiment, light is simultaneously emitted from a total of 18 narrowed portions (coupling portions between the adjacent light guiding members) 26 of the bar-shaped light guides 24 arranged along the outer cover 22, giving the tail lamp 20 an appearance of a multi-light type lamp.

The amount of light emission from the narrowed portions (coupling portions) 26 of the light guiding member 25 tends to decrease as the distance from the light-emitting portions 29 of the LEDs 28 increases. However, since in the above structure the light emitted from the LEDs 28 is incident from both end portions of the light guide 24 (coupling unit U1), the amount of light emission at the narrowed portions (coupling portions) 26 are substantially the same, thus providing uniform light emission from the entire outer cover 22.

Furthermore, on the side opposing the lamp chamber S of the lamp body 11, an aluminum deposited reflecting surface 11*a* is, as best seen from FIG. 2, provided. A red inner lens 30 which is not formed with steps is provided between the reflecting surface 11*a* and the light guide 24 (coupling unit U1) so as to be separated from the both elements 11*a* and 24. Accordingly, since light emitted from the narrowed portions 26 and the light guides 24 (coupling unit U1) are reflected repeatedly on the aluminum deposited reflecting surface 11*a*, the light-emitting portion appears further like a multi-light type light-emitting portion, and an innovative and striking pattern is presented on the outer cover 22 when the lamp is not lit.

More specifically, when the tail lamp 20 (LED 28) is lit, the narrowed portions (which are coupling portions between the light guiding members 25) 26 of the bar-shaped light guide 24 emit red light, and, naturally, such light emitted (red light) is visible through the transparent outer cover 22. The light emitted from the narrowed portions 26 is reflected on the reflecting surface 11*a* through the inner lens 30, and the red emitted light reflected on the reflecting surface 11*a* is also visible through the outer cover 22. Moreover, the red emitted light reflected on the reflecting surface 11*a* is reflected by the back face of the inner lens 30, thereby being reflected on the reflecting surface 11*a* again, and this light is also visible through the outer cover 22. Consequently, through the outer cover 22 that takes on the red color of the inner lens 30 and slightly emits light, the tail lamp 20 appears as if myriads of LEDs which are the light-emitting portions are installed, thus offering a significantly favorable appearance.

On the other hand, when the tail lamp 20 (LED 28) is not lit, the bar-shaped light guides 24 (coupling unit U1) is visible through the transparent outer cover 22. However, since the bar-shaped light guides 24 having a number of narrowed portions 26, which are reflected on the aluminum deposited reflecting surface 11*a*, appear like a "pattern having long narrow ovals continuing lengthwise and widthwise" through the red inner lens 30. Accordingly, the outer cover 22 or the reflector surface in the lamp chamber S appears as if it has an "innovative and striking step pattern having long narrow ovals continuing lengthwise and widthwise".

In particular, the light-emitting portion when the lamp is lit and the pattern when the lamp is not lit, which are the image that appears on the reflecting surface 11*a* due to the above-described repeated reflection, become smaller correspondingly as a light path becomes longer. Therefore, perspective is given to the light-emitting portion and the pattern, correspondingly giving a depth of the lamp chamber S of the tail lamp, thereby further improving the appearance.

Figure 4A:
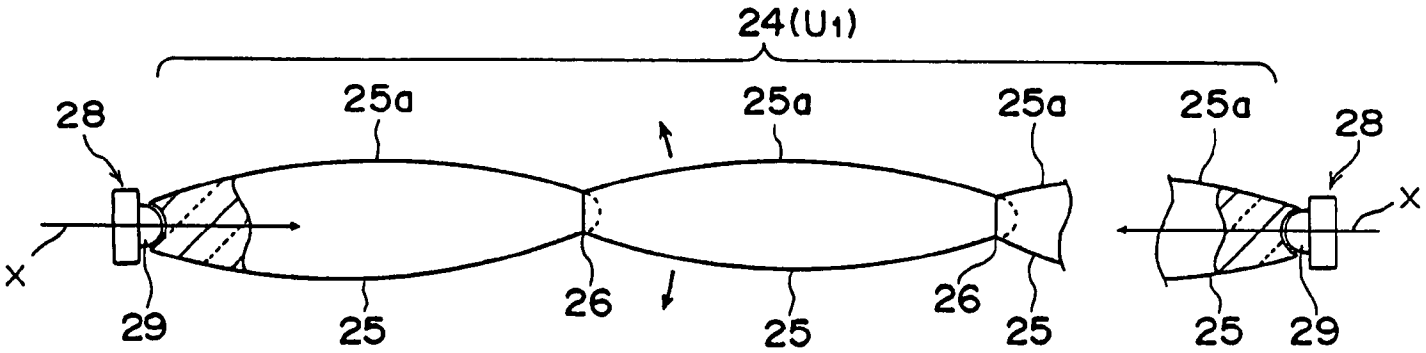
FIG. 4A shows part of the light guide (coupling unit) which is a main portion of a second embodiment of the present invention, FIG. 4B showing in cross-section the light guiding members that comprise the light guide (coupling unit)
Figure 4B:
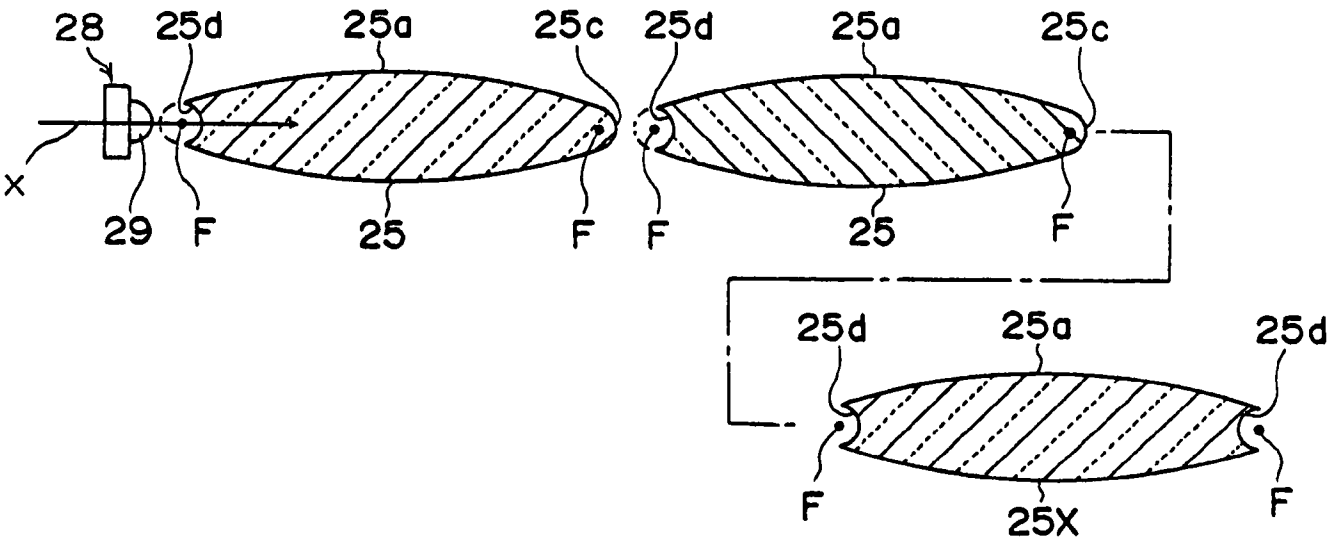

FIG. 4A and FIG. 4B show the second embodiment of the present invention. FIG. 4A shows a part of the light guide (coupling unit) which is a main portion of the second embodiment in which the present invention is applied to, as in the first embodiment, an automotive tail lamp, and FIG. 4B shows in cross-section the light guiding member constituting the light guide (coupling unit).

The coupling unit U1, a light guide 24 of this second embodiment, is composed of seven acrylic resin light guiding members 25 having an elliptical shape and integrally connected in series (some light guiding members 25 are omitted in FIGS. 4A and 4B).

More specifically, each light guiding member 25 is constituted of an elliptical body, the outer surface being the elliptical surface 25*a* that has a pair of focal points F. Such focal points F are located at both ends of each light guiding member 25. One end of the light guiding member 25 is formed with a recessed portion 25*d*, and the other end with a protruded portion 25*c*. The protruded portion 25*c* is formed so as to align with the recessed portion 25*d*. The protruded portion 25*c* of one light guiding member is engaged with (coupled to) the recessed portion 25*d* of another light guiding member, thus forming a coupling portion 26; and the coupling portion 26 between adjacent two light guiding members 25 which is a narrowed portion (or an engaging portion between the protruded portion 25*c* and the recessed portion 25*d*) is filled with a acrylic-based adhesive (not shown) that has substantially the same refractive index as acrylic resin constituting the light guiding member 25, so that the coupling portion 26 between the light guiding members 25 is fixed (seven light guiding members 25 are thus integrated as the coupling unit U1 at six coupling portions 26).

At each coupling portion 26, the protruded portion 25*c* and the recessed portion 25*d* are relatively rotatable (relatively oscillated) to some extent in directions shown by arrows in FIG. 4A. Consequently, by fixing the light guiding members 25 at the coupling portion 26 with angles, the light guide (coupling unit) 24 can be formed in a shape that follows the curved surface of the outer cover 22.

It should be noted that at least the light guiding member 25X, which is one of the plurality of light guiding members 25 of the coupling unit 24 (U1) and is located at one end thereof, needs to have recessed portions 25*d* at both ends thereof so that one of them is used for connection with another light guiding member and the other for receiving the light-emitting portion 29 of an LED 28.

Figure 5:
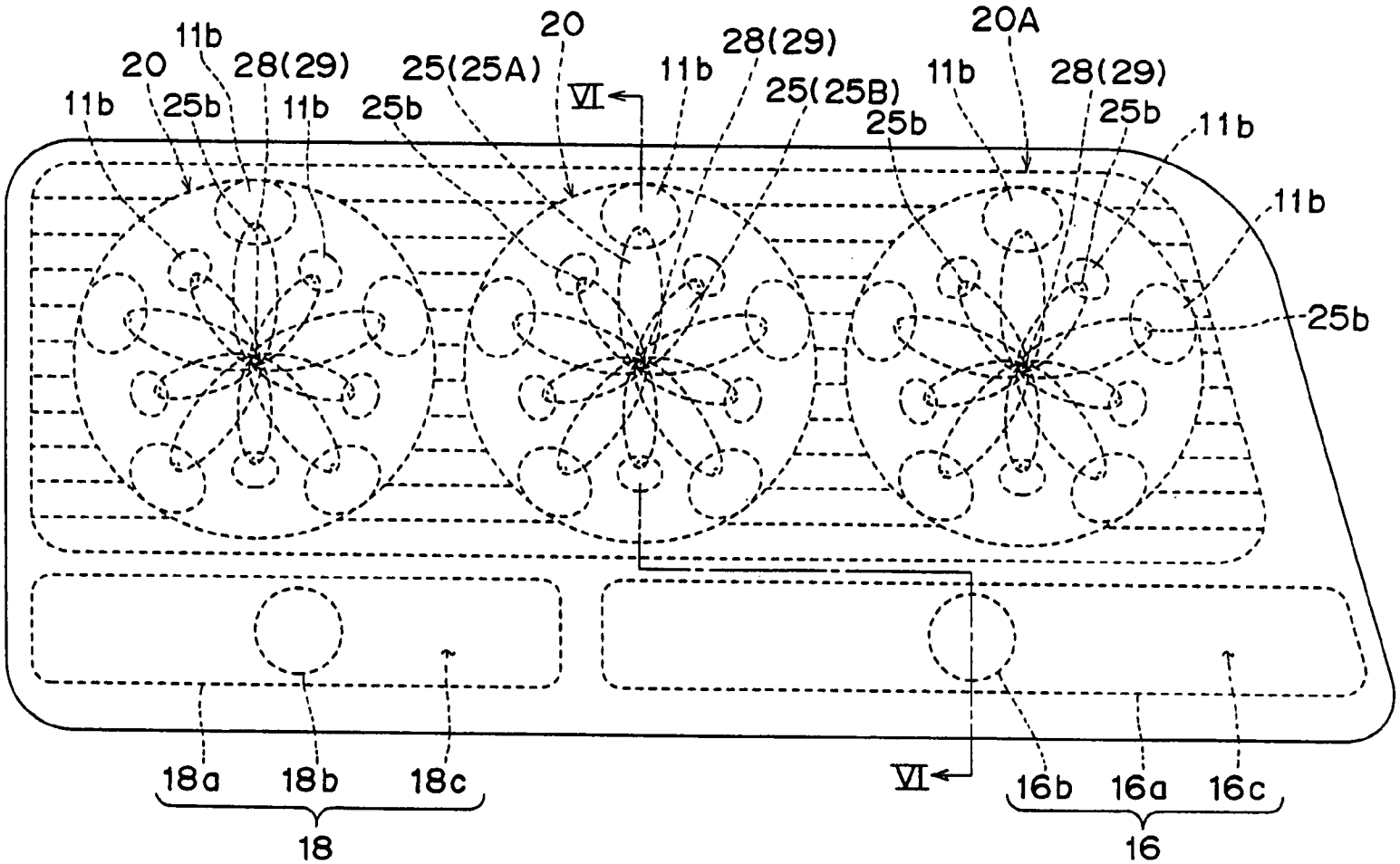
FIG. 5 is a front elevational view of an automotive rear combination lamp integrated with a tail lamp according to a third embodiment of the present invention.
Figure 6:
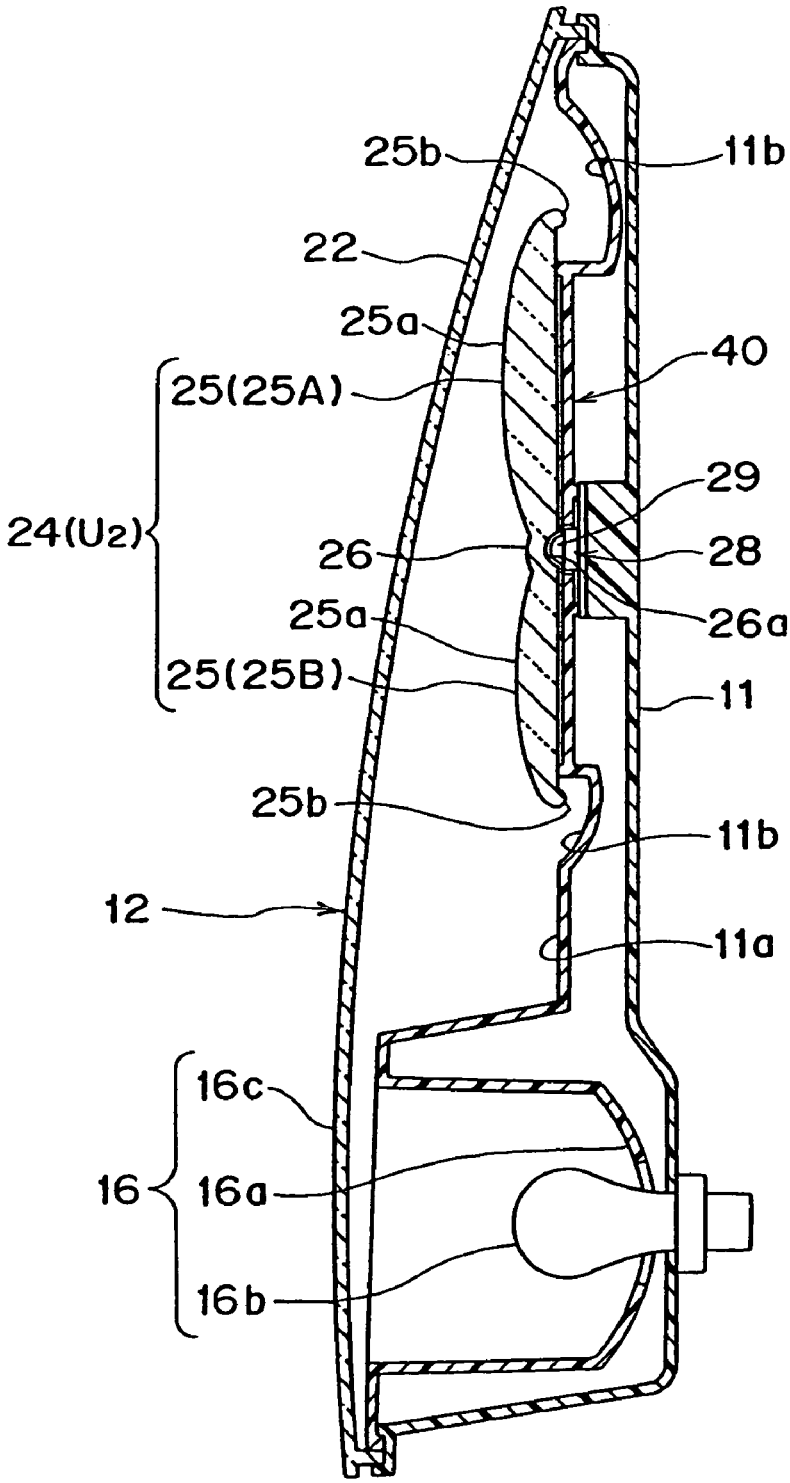
FIG. 6 is an enlarged longitudinal sectional view thereof taken along the line VI—VI in FIG. 5.
Figure 7:
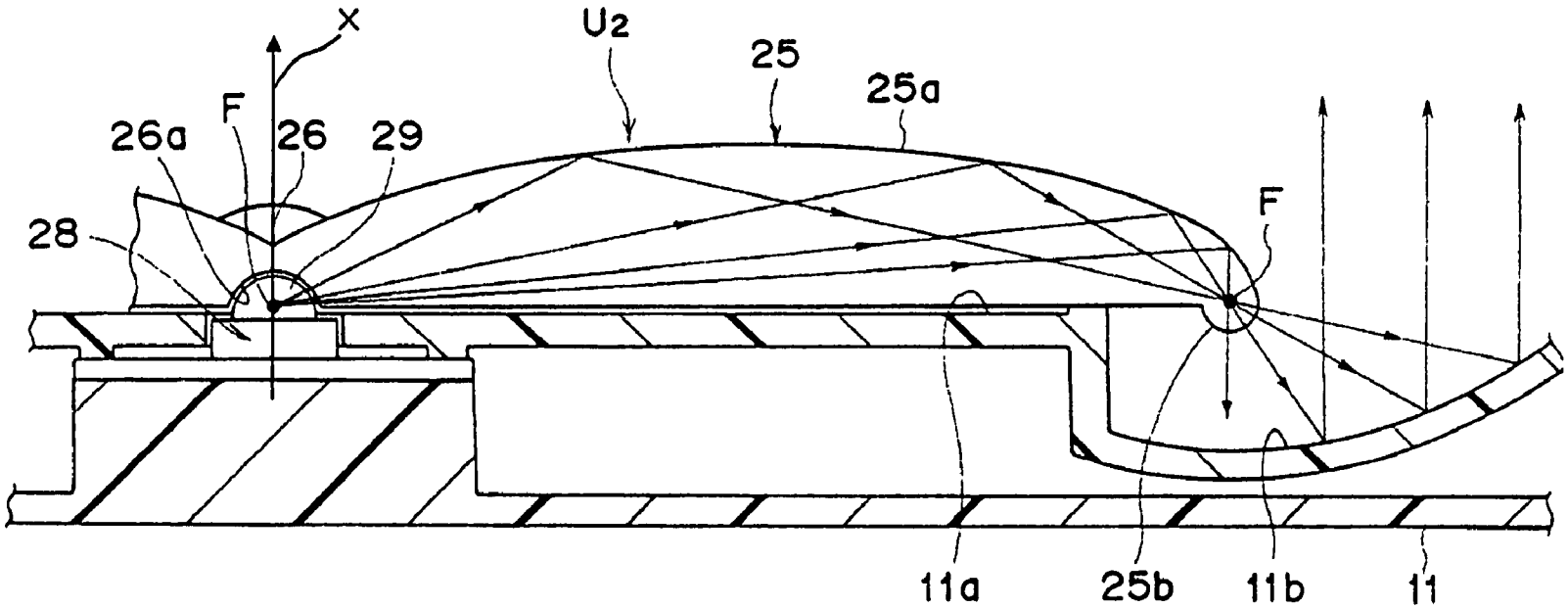
FIG. 7 is an enlarged sectional view of a main portion of the light guide (coupling unit) used in the lamp of FIG. 5.

FIGS. 5 to 7 show a third embodiment of the present invention. In this third embodiment as well, the lamp of the present invention is an automotive tail lamp as in the case of the first and second embodiments described above. FIG. 5 is a front elevational view of a rear combination lamp integrated with the tail lamp, and FIG. 6 is a longitudinal sectional view (taken along the line VI—VI in FIG. 5) of the rear combination lamp (tail lamp). FIG. 7 is an enlarged sectional view of the main portion of a light guide (coupling unit).

The light guide 24 in the first and second embodiments above is in the form of the coupling unit U1 in which a plurality of light guiding members 25 are connected in series. The light guide 24 according to the third embodiment is in the form of a coupling unit U2 which is an integrally molded unit of transparent acrylic resin and extends along the outer cover 22, in which a plurality of light guiding members 25, a surface of which being formed in the elliptical surface 25*a* that has a pair of focal points F, are coupled and integrated in a radial pattern so that they share one of the focal points at each coupling portion 26. In addition, the light guide 24 is arranged so that the shared focal point F of the elliptical surface 25*a* is located near the light-emitting portion 29.

More specifically, the light guiding member 25 constituting the light guide 24 (coupling unit U2) is constructed of a semi-elliptical body that is in a shape obtained by dividing an elliptical body, which has a single elliptical surface on its outside, longitudinally along a major axis thereof; and the elliptical surface 25*a* of the light guiding member 25 is provided so as to face the outer cover 22. As best seen from FIG. 6, two types of light guiding members 25 (the guiding members 25A and 25B, the major axes of the guiding members 25A are longer than the major axes of the guiding members 25B) are arranged alternately in the circumferential direction, thus forming the light guide 24 (coupling unit U2) that has a star shape in the front elevational view.

The back face of the central portion of the light guide 24 (the coupling portion 26 at the center of the coupling unit U2) is, as shown in FIG. 6, provided at its center with a semispherical recess 26*a* that has the shared focal point F of the respective elliptical surfaces 25*a*. The light-emitting portion 29 of a red LED 28 fits in the recess 26*a* from behind such that the optical axis x of the light-emitting portion 29 is orthogonal to the major axis of each semi-elliptical shape light guiding member 25 that has the elliptical surface 25*a*, and the center of the light-emitting portion 29 of the LED 28 coincides with the shared focal point F. Accordingly, red light emitted from the light-emitting portion 29 of the LED 28 and incident to each light guiding member 25 is internally reflected by (the elliptical surface 25*a* of) each light guiding member 25 shown in FIG. 7 and is condensed at the focal point F located at the other end (tip portion) of the light guiding member 25.

Moreover, as best seen from FIG. 7, a spherical portion 25*b* having the focal point F as a center thereof is formed on the back side of the tip portion of each light guiding member 25 such that light condensed at the focal point F is actively emitted from the spherical portion 25*b* in the rearward direction. In addition, at the back of the tip portion of each light guiding member 25, an aluminum deposited reflecting surface 11*b* which has a parabolic shape of a size sufficient to surround the spherical portion 25*b* and appears circular when viewed from the front is provided. Light emitted from each spherical portion 25*b* in the rearward direction is reflected by the reflecting surface 11*b* and distributed in the forward direction as shown by arrows in FIG. 7.

Accordingly, in this structure, red light from the light-emitting portion 29 of the LED 28 is condensed at the focal point F located at the tip portion of each light guiding member 25 constituting the light guide 24 and is then emitted from the spherical portion 25*b* so as to be reflected in the forward direction by the reflecting surface 11*b* provided behind the spherical portion 25*b*. Therefore, when the tail lamp 20 (LED 28) is lit, red light is slightly emitted from the central portion of the light guide 24, and the large and small circular reflecting surfaces 11*b* appear to emit red light at five locations, that is, at ten locations in total in correspondence with the outer circumferential positions of the light guides 24, and an innovative light emission mode is thus obtained.

The light guide 24 (coupling unit U2) is fixed in front of an extension reflector 40 disposed on the inner side of the lamp body 11, and the front surface of the extension reflector 40 is formed with an aluminum deposited reflecting surface 11*a* including the circular reflecting surface 11*b*. Therefore, the tail lamp 20 when it is not lit provides an innovative impression with the star-shaped light guide 24 (coupling unit U2) sparkling due to the light reflected by the aluminum deposited surface 11*a* of the extension reflector 40.

The reference numeral 20A denotes a stop lamp provided adjacent to the tail lamp 20, and it is completely identical to the tail lamp 20 in structure.

Other elements and structure are the same as those in the first embodiment described above, and therefore, repeated descriptions thereof is omitted.

Figure 8:
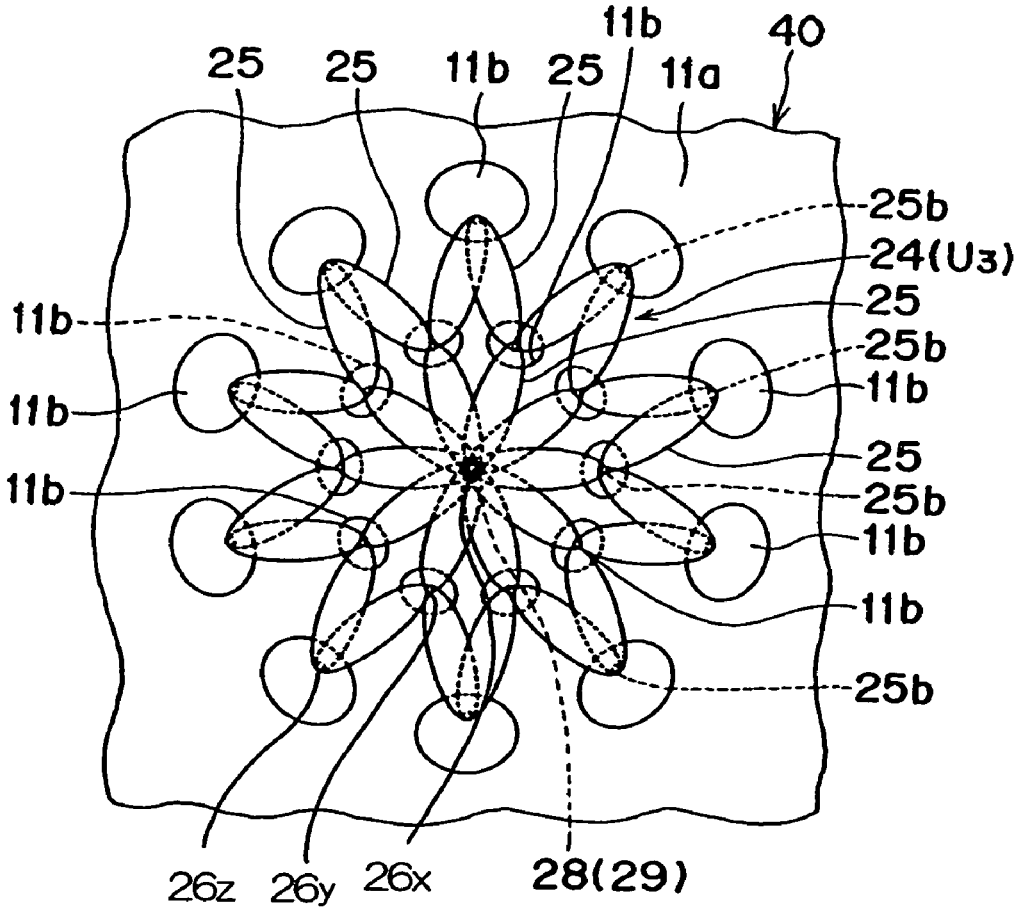
FIG. 8 is a front elevational view of a light guide (coupling unit) which is a main portion of the tail stop lamp according to a fourth embodiment of the present invention.

FIG. 8 shows a fourth embodiment of the present invention that is applied to an automotive tail lamp. FIG. 8 is a front elevational view of the light guide 24 (coupling unit U3) which is a main portion of the tail lamp of the fourth embodiment.

In the third embodiment above, the light guide 24 is constructed by two types of longer and shorter light guiding members 25 (25A and 25B). In the fourth embodiment, the light guide 24 is constructed of a coupling unit U3 which is composed of an integrally molded unit of acrylic resin, and the light guiding members 25 all have the same dimensions and are coupled and integrated at a coupling portion 26X.

More specifically, ten light guiding members 25 are radially arranged so as to share one of the focal points at the coupling portion 26X. In regards to the tip portion of respective light guiding members 25 arranged in the radial pattern, an arrangement is made so that the light guiding members 25 connected in series share the focal point with each other at coupling portions 26Y, and the light guiding members 25 that are adjacent with each other in the circumferential direction share the focal point with each other at coupling portions 26Z at the tip ends.

The spherical portion 25*b* having the focal point F as a center thereof (see FIG. 6) is formed on the back side of each coupling portion 26 of the light guiding member 25, and the extension reflector 40 behind the light guide 24 is provided with a circular-shaped aluminum deposited reflecting surfaces 11*b* so as to positionally correspond to the spherical portion 25*b*. Light emitted and condensed at the focal point F of the coupling portion 26 is emitted from the respective spherical portions 25*b* in the rearward direction and reflected by the reflecting surfaces 11*b*, whereby red light is emitted from large and small circular-shaped reflecting surfaces 11*b* which are arranged in a circular form at a total of 20 locations.

The above tail lamp gives, when it is not lit, an innovative impression in which the star-shaped light guide 24 (coupling unit U3) further sparkles compared to the above-described third embodiment by the light reflected by the aluminum deposited surfaces 11*b* of the extension reflector 40.

Figure 9:
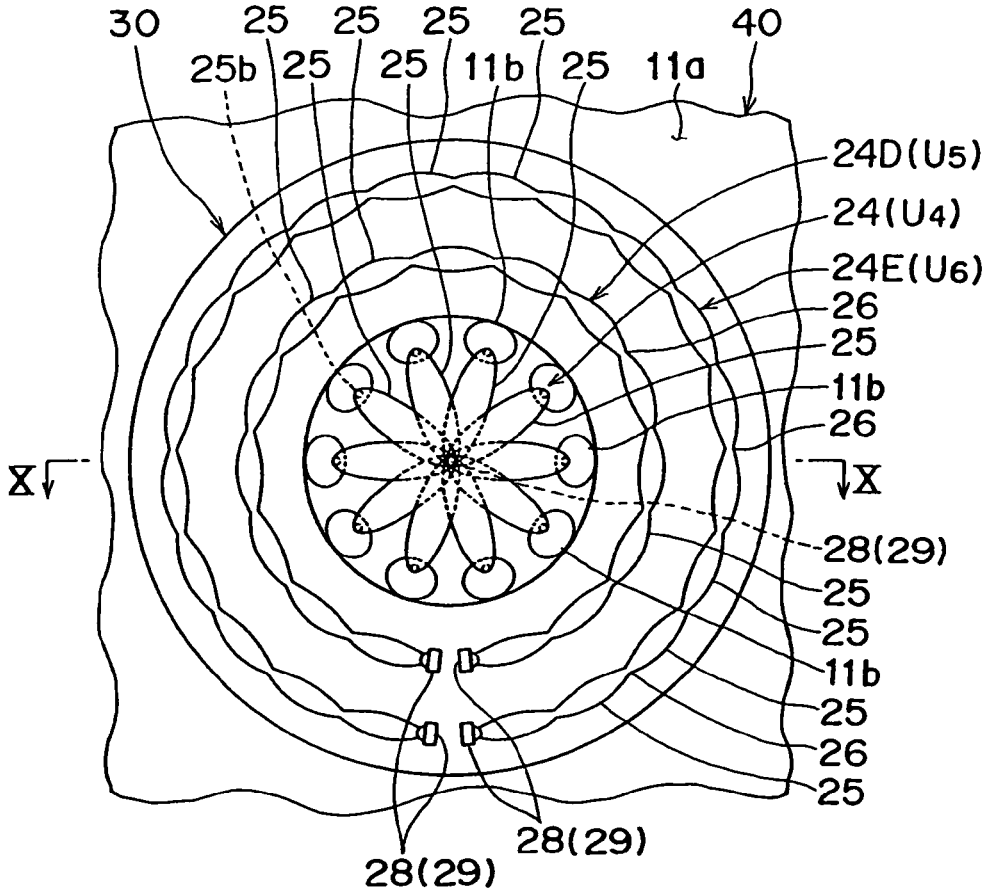
FIG. 9 is a front elevational view of a light guide (coupling unit) which is a main portion of the tail stop lamp according to a fifth embodiment of the present invention.
Figure 10:
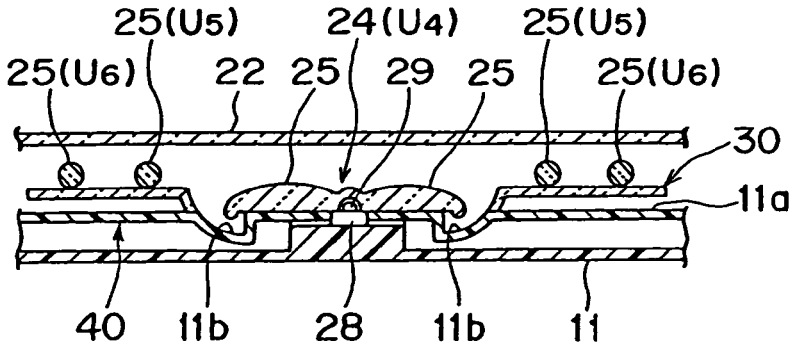
FIG. 10 is a sectional view thereof taken along the line X—X in FIG. 9.
Figure 11:
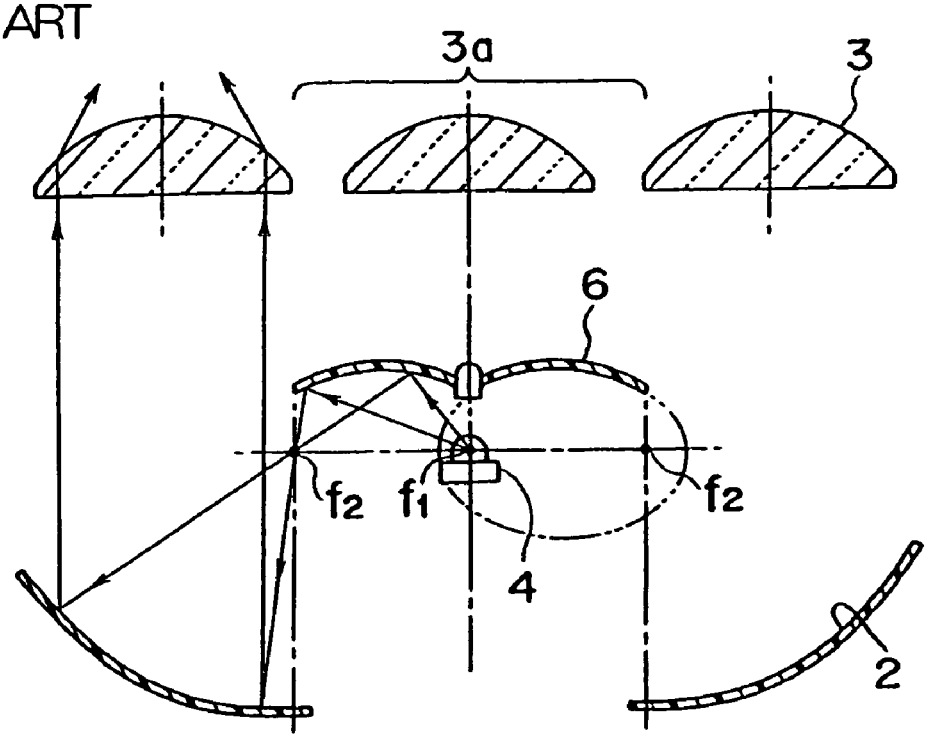
FIG. 11 PRIOR ART
FIG. 11 is a sectional view of a prior art vehicular lamp.
Figure 12:
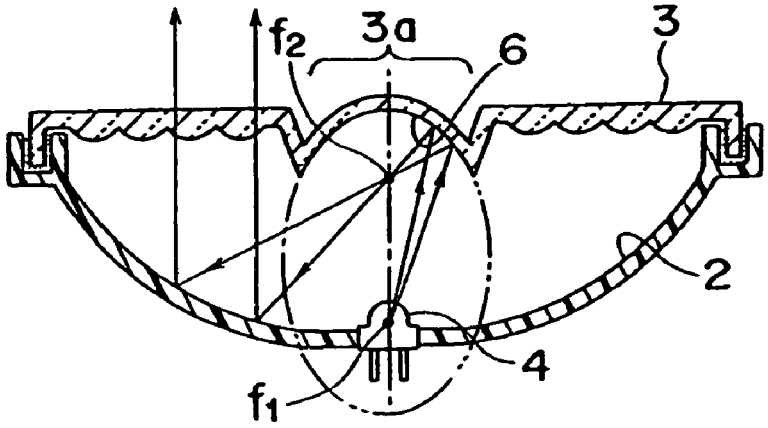
FIG. 12 PRIOR ART
FIG. 12 is a sectional view of another prior art vehicular lamp.
Figure 13:
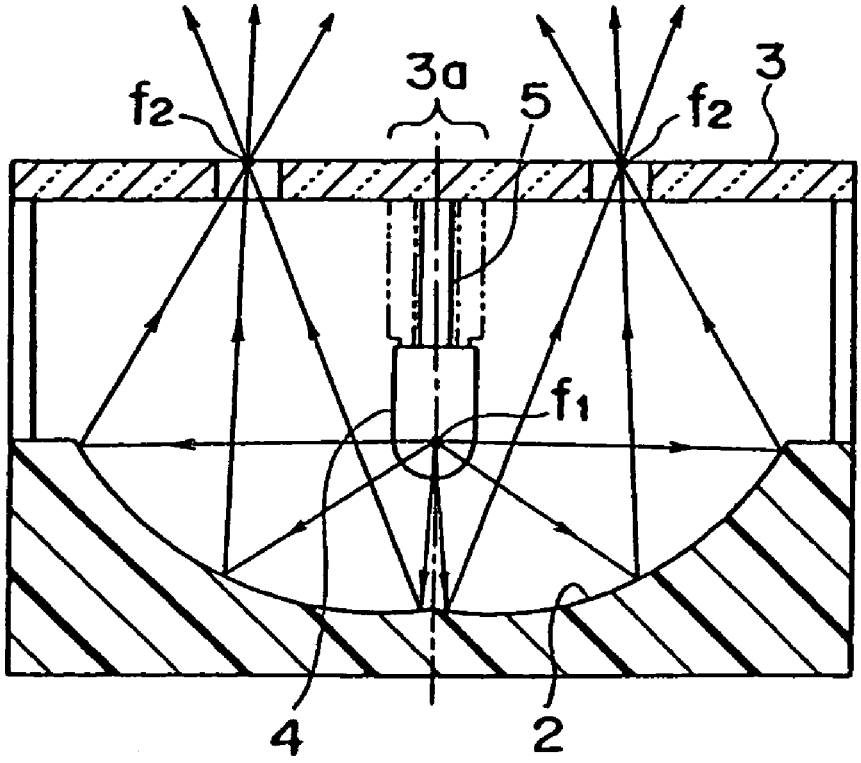
FIG. 13 PRIOR ART
FIG. 13 is a sectional view of a still another prior art vehicular lamp.

FIGS. 9 and 10 show a fifth embodiment in which the present invention is applied to an automotive tail lamp. FIG. 9 is a front elevational view of the light guide (coupling unit) which is a main portion of the tail lamp, and FIG. 10 is a sectional view of the main portion of the tail lamp (sectional view taken along the line X—X in FIG. 9).

The central portion of the inside of a lamp chamber of the tail lamp in this fifth embodiment is provided with a first coupling unit U4 which is a light guide 24 having a construction substantially identical to that of the light guide 24 of the third embodiment (see FIG. 5). Around the first coupling unit U4, second and third coupling units U5 and U6 which are a light guide 24D and light guide 24E are concentrically arranged. Each of the light guides 24D and 24E is comprised of elliptical light guiding members 25 each having a pair of focal points F, and these light guide members 25 are coupled in series and integrated in a circular form so that they share one of the focal points with each other at a narrowed portion (coupling portion) 26.

The back side of the central portion of the light guide 24 (coupling unit U4) is, as seen from FIG. 10, provided with an LED 28, and light emitted from the light-emitting portion 29 of the LED 28 is emitted from the spherical portion 25*b* provided on the back side of the tip portion of each light guiding member 25 of the light guide 24 (coupling unit U4) so as to be reflected by the reflecting surface 11*a*, and the reflecting surface 11*a* emits red light.

On the other hand, both end portions of each one of the circular-shaped light guides 24D and 24E (coupling units U5 and U6) are provided with the light-emitting portions 29 of LEDs 28, and light emitted from the light-emitting portions 29 of the LEDs 28 of each one the light guides 24D and 24E is guided inside the light guiding member 25 of these light guides 24D and 24E and condensed at each focal point F, thus emitting light from each narrowed portion (coupling portion) 26 of these light guides 24D and 24E.

An aluminum deposited reflecting surface 11*a* is, as seen from FIG. 10, formed on the extension reflector 40 on the side opposing the outer cover 22. A red inner lens 30 which is not formed with steps is disposed between the reflecting surface 11*a* and the light guides 24D and 24E (coupling units U5 and U6) in such a manner that it is separated from the reflecting surface 11*a*. Thus, since light emitted from the narrowed portions 26 and the light guide 24 (coupling units U4 and U5) are repeatedly reflected on the aluminum deposited reflecting surface 11*a* on the back side of the inner lens 30, the light-emitting portion (formed by the light guide 24, 24D and 24E) further appears like a multi-light type light-emitting portion, and an innovative and striking pattern is presented on the outer cover 22 when the lamp is not lit.

The circular-shaped coupling units U5 and U6 are fixed to the inner lens 30 by adhesives or the like at a plurality of locations thereof.

In the light guides 24, 24D and 24E (coupling units U1, U5 and U6) in the first and fifth embodiments above, light is incident from the LEDs 28 provided at both ends thereof. The light can be emitted from one end only by way of installing the LED only at one end of the coupling unit. However, in this single LED structure, so to compensate loss of the amount of light emission, it would be necessary to provide a retroreflective reflecting surface at the end which is on the opposite side from the end where the LED is provided so that the light of the LED at one end is reflected and advances back to the LED.

Moreover, in the first and second embodiments above, each one of the light guiding members 25 constituting the light guide 24 is comprised of an elliptical body, and it has a single elliptical surface on its entire outer surface. However, each light guiding member 25 in the first and second embodiments can be of a semi-elliptical body that is made by dividing an elliptical body longitudinally along the major axis as in the third and fourth embodiments.

Also, in the third and fourth embodiments above, each one of the light guiding members 25 constituting the light guide 24 is comprised of a semi-elliptical body obtained by longitudinally dividing an elliptical body, which has a single elliptical surface on its entire outer surface, along the major axis. However, in the third and fourth embodiments, the light guiding member 25 can be an elliptical body and not a semi-elliptical body.

Furthermore, in the above-described embodiments, the present invention is applied to a tail lamp and a stop lamp. However, the present invention is certainly applicable to other types of lamps in addition to those mentioned above.

As seen from the above, according to the first aspect of the present invention, each coupling portion of the light guiding member that constitutes a coupling unit emits light when a single LED is lit, and such an LED appears to emit light at a plurality of locations within a lamp chamber through a front cover. Consequently, the lamp appears like a multi-light type lamp, offering a good appearance.

When two LEDs are provided at both ends of a coupling unit and are lit as shown in the second aspect of the present invention, each coupling portion of the light guiding members that form the coupling unit emits light more brightly. Thus, the lamp appears like a multi-light type lamp in which the LED emits bright light having a uniform brightness at a plurality of locations within the lamp chamber through the front cover.

In addition, in the third aspect of the present invention, light emitted from the LED is incident to the light guide efficiently, and the amount of light emission at a plurality of locations of the light guide increases, and the visibility of the lamp improves.

Furthermore, since in the fourth aspect of the present invention light can be guided into the coupling unit efficiently without involving loss of light emission of the LED, the amount of light emission increases, and the visibility of the lamp improves.

Moreover, since the work for coupling the light guiding members with each other is unnecessary, installation of the light guide to the lamp is accordingly simple.

Furthermore, in the fifth aspect of the present invention, the light guiding members that constitute the coupling unit are in the same shape and size, and the manufacturing cost thereof is low. Accordingly, the lamp can be provided at a low cost.

In this the fifth aspect of the present invention, the light guiding members can be coupled (or connected) easily, and further the light guide (which is a coupling unit) can be arranged in shape so as to follow the shape of the curved surface of a front cover. Accordingly, the present invention is applicable to a lamp that has a front cover that curves sharply, for example, to a lamp that has a front cover with a large slant angle that curves sharply to the side.

Furthermore, in the sixth aspect of the present invention, when a single LED is lit, the tip portions, in a radial direction, of the light guiding members constituting a coupling unit emits light, and the lamp appears like a multi-light type lamp in which the LEDs emit light at a plurality of locations within a lamp chamber through its front cover. Thus, the lamp has a good appearance.

In addition, in the seventh aspect of the present invention, since light emitted from the LED is efficiently and uniformly distributed and guided to each light guiding member, the amount of light emission from the light guide increases, and light is emitted uniformly from each light-emitting portion. Thus, the visibility of the lamp improves.

The invention claimed is:

1. A vehicular lamp comprising a lamp chamber, which is defined by a lamp body and a front cover, and a light guide, which emits light at a plurality of locations thereof by guiding, by internal reflection, light emitted from an LED that is a light source of said vehicular lamp, wherein:

the light guide is constructed of a coupling unit in which a plurality of light guiding members, each one of the light guiding members being formed with an elliptical surface having a pair of focal points, are coupled in series at coupling portions so that the light guiding members share one of the focal points with each other at each one of the coupling portions; and a light-emitting portion of the LED is provided near at least one of the focal points at both ends of the coupling unit.

2. The vehicular lamp according to claim 1, wherein each one of both ends of the coupling unit is provided with the LED.

3. The vehicular lamp according to claim 1 or 2, wherein said each one of the light guiding members is comprised of one of elliptical bodies selected from an elliptical body that has a single elliptical surface on an entire outer surface thereof and a semi-elliptical body that is made by dividing the elliptical body longitudinally along a major axis thereof, said each one of the light guiding members being provided such that an elliptical surface thereof faces the front cover; and one of the light guiding members that faces the light-emitting portion of the LED is provided such that a major axis of said each of the light guiding members substantially coincides with an optical axis x of the light-emitting portion of the LED.

4. The vehicular lamp according to claim 3, wherein the coupling unit is an integrally molded resin unit.

5. The vehicular lamp according to claim 3, wherein each one of the light guiding members is provided with a recessed portion at one end thereof and a protruded portion at another end thereof so as to be aligned with the recessed portion, and the protruded portion of one light guiding member is engaged with the recessed portion of another light guiding member so as to couple the light guiding members with each other.

6. The vehicular lamp according to claim 1 or 2, wherein the coupling unit is an integrally molded resin unit.

7. The vehicular lamp according to claim 1 or 2, wherein each one of the light guiding members is provided with a recessed portion at one end thereof and a protruded portion at another end thereof so as to be aligned with the recessed portion, and the protruded portion of one light guiding member is engaged with the recessed portion of another light guiding member so as to couple the light guiding members with each other.

8. The vehicular lamp according to claim 1 or 2, wherein said each one of the light guiding members is comprised of one of elliptical bodies selected from an elliptical body that has a single elliptical surface on an entire outer surface thereof and a semi-elliptical body that is made by dividing the elliptical body longitudinally along a major axis thereof, said each one of the light guiding members being provided such that an elliptical surface thereof faces the front cover; and and the LED behind a central portion of the coupling unit is provided such that an optical axis x of the light-emitting portion of the LED is orthogonal to the coupling unit.

9. A vehicular lamp comprising a lamp chamber, which is defined by a lamp body and a front cover, and a light guide, which emits light at a plurality of locations thereof by guiding, by internal reflection, light emitted from an LED that is a light source of said vehicular lamp, wherein:

the light guide is constructed of a coupling unit in which a plurality of light guiding members, a surface of each one of the light guiding members being formed with an elliptical surface having a pair of focal points, are coupled and integrated in a radial form at a coupling portion so that the light guiding members share one of the focal points with each other at the coupling portion; and a light-emitting portion of the LED is provided near the shared focal points located behind the LED.

* * * * *